United States Patent [19]

Pottorff

[11] Patent Number: 4,653,372

[45] Date of Patent: Mar. 31, 1987

[54] SELF-SHARPENING HOLE PUNCH FOR PLASTIC BAGS

[76] Inventor: Earl T. Pottorff, 2346 Taylor Rd., Savannah, N.Y. 13146

[21] Appl. No.: 748,920

[22] Filed: Jun. 26, 1985

[51] Int. Cl.[4] ..... B26F 1/18; B26F 1/14

[52] U.S. Cl. ..... 83/689; 83/542; 83/684

[58] Field of Search ..... 83/100, 684, 689, 698, 83/542, 684

[56] References Cited

U.S. PATENT DOCUMENTS

| | | | |
|---|---|---|---|
| 1,451,610 | 4/1923 | Gestas | 83/100 X |
| 3,469,488 | 9/1969 | Gaspari | 83/684 X |
| 3,550,494 | 12/1970 | Adams | 83/99 |
| 3,973,453 | 8/1976 | Tameo | 83/636 X |

OTHER PUBLICATIONS

Jackson et al., Acetal Homopolymer, Modern Plastics Encyclopedia pp. 8–9, 1985.

*Primary Examiner*—James M. Meister
*Assistant Examiner*—John L. Knoble
*Attorney, Agent, or Firm*—Bruns and Wall

[57] ABSTRACT

A self-sharpening hole punch for plastic bags includes a pneumatically operated punching apparatus for punching wicket pin receiving holes in a flexible film or plastic bag. If desired, a tear slit may be simultaneously formed to enable the bag to be quickly and readily torn free from the wicket pin upon which the bag is retained. The disclosed embodiment utilizes a pneumatic air cylinder having a free end of the cylinder rod having a fitting secured thereto having an internal tapered bore. Interchangeable plastic cutting tools, having a complementary tapered thread, may be interchangeably threaded into the fitting to facilitate replacement as necessary.

6 Claims, 3 Drawing Figures

SELF-SHARPENING HOLE PUNCH FOR PLASTIC BAGS

BACKGROUND OF THE INVENTION

This invention relates in general to hole punching apparatus and, in particular, to an apparatus for punching holes in packaging material.

More specifically, but without limitation to the particular apparatus described herein for purposes of disclosing a preferred embodiment, and the best mode presently known for carrying out the invention, this invention relates to an apparatus for punching holes in flexible film or plastic bags.

As is known to those skilled in the art, flexible plastic film or plastic bags formed from materials such as polyethylene, are frequently used to package articles such as loaves of bread. In such operations, a quantity of these bags is retained on a substantially U-shaped wicket pin with the bags being carried thereon by positioning the free ends of the wicket pin through a pair of holes formed in the upper portion of the bag. The bags may then be individually removed from the wicket pin and an article such as a loaf of bread, is placed in the bag.

In order to hold the bags on the wicket pin in a proper position so that the bags may be loaded, it is necessary to form a pair of holes in the bag through which the free ends of the wicket pin pass. In certain applications it is also advantageous to be able to quickly pull or tear the bag from the wicket pins, rather than withdrawing the bag from the wicket pins upon which the bags have been placed. To this end, provision must be made so that when the bag is pulled to be torn free from the wicket pins, the bag material will tear in a predictable manner. In this way the bag can be readily removed while maintaining the integrity of the receptacle portion thereof into which an item is placed.

Various mechanisms have been provided to punch such holes in plastic materials. Two such devices are disclosed in U.S. Pat. No. 3,550,494 "MULTIPUNCH SYSTEM FOR FLEXIBLE FILM PRODUCTS" and U.S. Pat. No. 3,973,453 "RADIAL ALIGNED PUNCH". Each of these patents disclose an apparatus for perforating flexible film products such as a plastic bag, so that the bag can be supported for releasable retention on a wicket pin by passing the arms of the wicket pin through openings formed in the plastic material. U.S. Pat. No. 3,973,453 also discloses a punch member having a single cutting line face for forming a line slit in projected continuation with the line slit forming the wicket pin receiving opening to facilitate easy removal of the bag structure from the wicket pin.

U.S. Pat. Nos. 3,654,829; 4,160,396 and 4,308,774 each disclose additional apparatus for perforating thermoplastic material utilizing a serrated knife edge to cut or punch a hole in a plastic film. Heretofore such cutters have been formed from metal and require frequent periodic sharpening so that they will be keen enough to cut through the plastic. During the cutting operation, the plastic material is supported upon a backing plate having a hole formed therein which is of a diameter larger than the cutting tool. The backing plate so formed enables the cutting tool to move through the plastic material while the material is held in position against the plate.

The use of metal cutting tools as used in the prior art is satisfactory as long as the cutting tool remains sharp, and the tool and hole in the backing plate are maintained substantially concentrically out of contact during the high speed punching operation. The hole in the backing plate must be relatively close to the same size as the punching die or cutting tool to prevent stretching of the plastic material. If proper alignment is not maintained the teeth of the cutter will be broken requiring replacement of the entire cutting head. In addition, the cutting of the thermoplastic material rapidly wears the metal cutting surfaces thus dulling the cutting tool and requiring regrinding or resharpening of the cutting edge. The wear soon becomes excessive and the tool must be replaced.

SUMMARY OF THE INVENTION

It is, therefore, an object of this invention to improve apparatus for punching holes in thermoplastic material.

It is a further object of this invention to maintain the sharpness of a cutting edge utilized to punch holes in thermoplastic material.

Yet another object of this invention is to accommodate the use of various size cutting tools which may be interchangeably mounted on a base member.

Still another object of this invention is to reduce the weight of the cutting apparatus to minimize the inertial forces created during the high speed punching operation, thereby reducing wear and eliminating the necessity of complex mechanical systems.

These and other objects are attained in accordance with the present invention wherein there is provided a mechanically operated punching apparatus for punching wicket pin receiving holes in a flexible film or plastic bag. If desired, a tear slit may be simultaneously formed to enable the bag to be quickly and readily torn free from the wicket pin upon which the bag is retained. The disclosed embodiment utilizes a pneumatic air cylinder wherein the free end of the cylinder rod has a fitting secured thereto containing an internal tapered bore. Interchangeable plastic cutting tools, having a complementary tapered thread, may be interchangeably threaded into the fitting to facilitate replacement as necessary.

DESCRIPTION OF THE DRAWINGS

Further objects of the invention together with additional features contributing thereto and advantages accruing therefrom will be apparent from the following description of a preferred embodiment of the invention which is shown in the accompanying drawings with like reference numerals indicating corresponding parts throughout wherein.

DESCRIPTION OF THE PREFERRED EMBODIMENT

Figure 1:
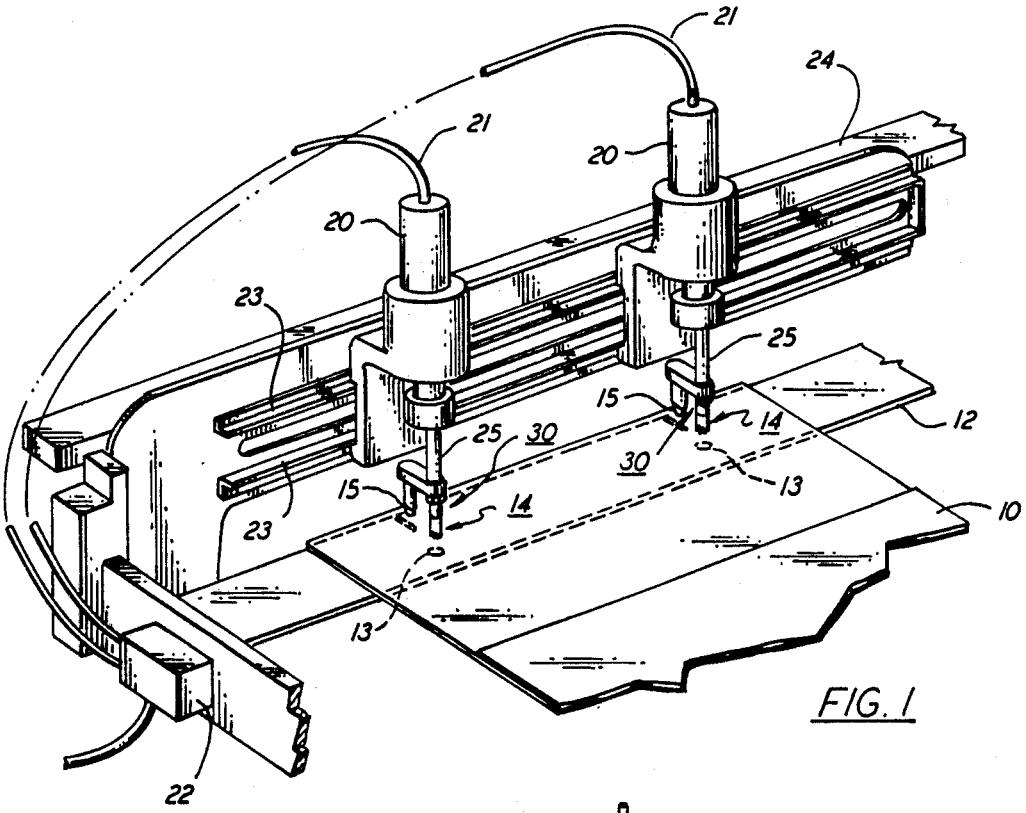
FIG. 1 is a front perspective view of an apparatus embodying the invention for cutting holes in plastic bags.
Figure 2:
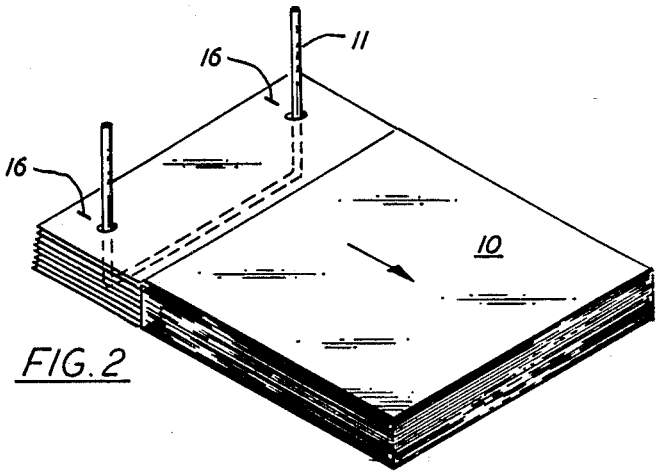
FIG. 2 is a frontal perspective view of a quantity of plastic bags having holes punched therein and positioned on a wicket pin for further processing.

Referring now to FIG. 1, there is illustrated an apparatus for punching holes in flexible plastic film or plastic bags 10 so that these bags may be placed on a substantially U-shaped wicket pin 11 as shown in FIG. 2. In operation, the plastic bag 10 is positioned on a backing plate 12 by means of, for example, a sheet feeding device, not shown. The backing plate 12 has a plurality of apertures 13 formed therein which are of a size slightly larger than a cutting head 14 by which holes in the bag 10 are formed. Slit cutters 15 permit the cutters to form predetermined slits 16 in the plastic bag preventing the plastic material from stretching or being sufficiently resistive to being torn from the wicket pin 11 that the receptacle portion of the bag is rendered useless.

While the apparatus in FIG. 1 discloses a pair of adjustable pneumatically operated cylinders 20 as being used for the punching mechanisms, it is to be understood that the cutting tool to be hereinafter described in detail may be utilized with various reciprocating devices. A plurality of units may be mounted to a single operable punching cylinder or a greater number of cylinders may be utilized depending upon the particular punch apparatus and the number of holes to be formed on bags to be simultaneously processed.

The punching mechanism illustrated in FIG. 1 comprises an air operated cylinder 20 connected by suitable conduits 21 to a controller 22 whereby the air cylinders may be sequentially operated in synchronism with the feeding of the plastic bags 10 onto the backing plate 12. A pair of guides 23 are positioned on a cantilevered support arm 24 to permit the cylinders 20 to be positioned transversely of the bag to accommodate various positioning for the holes to be formed therein. Similarly, the backing plate 12 can be formed with a series of apertures 13 positioned in predetermined spacial relationship to accommodate lateral spacing of various standard wicket pins 11. Depending upon the particular application wherein the plastic bag is utilized, the slitter 15 may be carried on the cylinder rod 25 of the punching apparatus to provide the slit 16 between the hole formed by the cutting head or punch 14 and an adjacent edge of the plastic bag. As discussed previously, such a slit 16 will provide a frangible portion such that when the bag 10 is pulled from the wicket pin 11 in the direction indicated in FIG. 2, the bag will be torn free from the wicket pin 11 in a predetermined manner. Slitting may be required or desirable in an application wherein the bags 10 are to be contained on the wicket pin 11 and an article such as a loaf of bread, not shown, is inserted into the bag which is thereafter torn free from the wicket pin to be conveyed for further processing.

Figure 3:
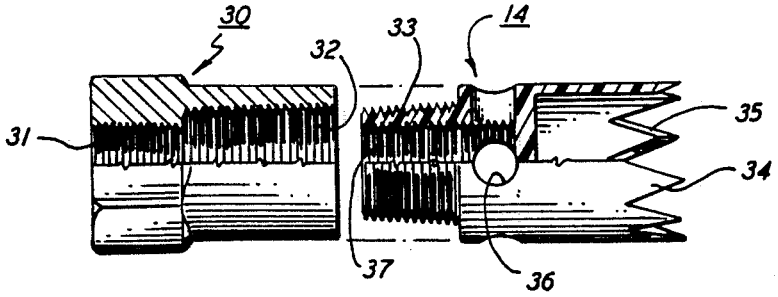
FIG. 3 is an enlarged planar view of the cutting tool utilized in the apparatus shown in FIG. 1 with portions thereof broken away to better illustrate the construction thereof.

As best shown in FIG. 3, the cutting tool of the hole punching apparatus includes a base coupling 30 formed of metallic material and having an internal thread portion 31 by which the base coupling 30 is secured to the free end of the retractable cylinder rod 25 of the pneumatic cylinder 20. This metallic portion is formed at its opposite end with an internal tapered thread 32 for receiving a complementary tapered external thread 33 of the cutting head 14. The cutting head is formed of a plastic material such as Delrin, a trademark of Dupont company for a base plastic material namely homopolymer acetal resin. While other plastic materials may be suitable, it has been found that TEFLON, a trademark for DuPont Corporation for tetrafluoroethylene is too soft for this use. Ceramic material has been found to be too brittle and, therefore, Delrin or a semirigid thermoform type of resin with its qualities has been found to be the preferable material for forming the cutting head 14. This material has been found to be resilient enough so that if the cutting head 14 contacts the backing plate 12 during the punching operation, the plastic material has sufficient flexibility to permit the cutting operation to continue, rather than breaking the cutting teeth 34 formed on the cutting head.

In prior art devices which utilize cutters formed of metal, when the cutting head contacted the side walls or the backing plate itself, the cutting teeth were broken. This breakage required the machine to be shut down, disassembled, and the entire cutting head had to be replaced or reground depending upon the severity of the break. With the use of an interchangeable cutting head 14 of flexible semirigid plastic Delron material, not only is the breakage problem eliminated, but changing the size of the holes to be punched in the plastic material can be readily varied. The machine operator has only to unscrew the tapered thread 33 of the plastic cutting head 14 from the metallic base portion 30 and insert a new cutter head to accommodate changing the hole size. The use of tapered threads insures a tight connection. In addition, when the plastic cutting head 14 finally becomes worn and must be replaced, the cutting head can be merely unscrewed from the base portion and another plastic cutting head inserted. This ease of replacement permits inexpensive and rapid replacement of the operating cutting portion 14 of the punching apparatus, without necessitating substantial periods of down time.

Another benefit that has been attained by the use of these Delrin type plastic cutting heads 14 is that the cutting head lasts far longer than a conventional metallic cutting head which is utilized in the prior art. For example, it has been found that the tapered knife edge portions 35 which are formed on the pointed cutting teeth 34 circumferentially spaced about the free end of the cutting head 14, actually form a self-sharpening cutting edge when punching holes in the plastic material. These replaceable cutting heads 14 are found to last four times as long as metal cutting heads utilized in the prior art, and accordingly are much less expensive both from an initial cost standpoint and replacement cost. It is believed that this self-sharpening occurs because of the plastic on plastic abrasion.

In addition, the lighter weight of the plastic cutting head 14 results in less wear on the mechanical components of the punching apparatus, which also helps reduce loosening of the tapered threaded portion 33 of the cutting head 14 from within the internal threaded portion 32 of the connector fitting 30. A plurality of vent holes 36, spaced circumferentially about the plastic cutting head 14 in communication with an internal base 37 formed coaxially in the cutting head 14, accommodate insertion of a lever arm to facilitate tightening or loosening in the cutting head 14 from the connector base 30 and in addition prevent air pressure from interfering with high speed punching operations.

While the invention has been described in the specification and illustrated in the drawings with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment illustrated by the drawings and described in the specification as the best way presently known for carrying out the invention but that the invention will include any embodiment falling within the scope of the appended claims.

I claim:

1. In an apparatus for punching holes in a web of plastic film material wherein the plastic film material is registered in alignment with a reciprocable punching apparatus which is actuated for reciprocating movement in a direction normal to the plane of the plastic film material for passing a cutting head through an apertured backing plate upon which the plastic film material is supported thereby punching a hole in the plastic film material, the improvement comprising an interchangeable plastic cutting head carried on the free end of the punching apparatus and having a tapered thread for removably retaining said plastic cutting head upon said free end of the reciprocable punching apparatus, said cutting head being formed of a flexible semi-rigid thermoformable resin material with a plurality of peripheral spaced and tapered serrated cutting teeth said teeth being bevelled to form a cutting edge at the periphery thereof such that said cutting head is self-sharpening when employed to cut holes in the plastic film material, said resin material being sufficiently resilient such that if the cutting head contacts the backing plate during a punching operation, the cutting teeth will resiliently deflect rather than break off, so that the cutting operation can continue.

2. The apparatus of claim 1 wherein said cutting head is formed of thermoformable plastic material referred to by the trademark Delrin or other semi rigid thermoformable materials.

3. The apparatus of claim 2 wherein said cutting head is cylindrical and has an end opposite said tapered thread formed with a plurality of circumferentially spaced tapered serrated cutting teeth.

4. The apparatus of claim 2 wherein the free end of said reciprocable punching apparatus includes a connector coupling having an internal tapered thread and said plastic cutting head is formed with a complementary external tapered thread for engagement therewith.

5. The apparatus of claim 3, wherein said plastic cutting head is formed with an axial bore extending therethrough and a plurality of circumferentially spaced vent holes extending transverse to said axial bore and in communication therewith.

6. The apparatus of claim 3 and further including a slitter knife secured adjacent to said free end of the punching apparatus for forming a slit in a predetermined position relative to the hole formed by said cutting head.

* * * * *